US006368263B1

(12) United States Patent
Lynch et al.

(10) Patent No.: US 6,368,263 B1
(45) Date of Patent: Apr. 9, 2002

(54) PUNCH CONFIGURATION SYSTEM AND METHOD

(75) Inventors: Richard James Lynch, Peabody; John L. Colfer, Dracut; Thomas K. Hebert, Groveland; John W. Edwards, Jr., Clinton, all of MA (US)

(73) Assignee: Agfa Corporation, Wilmington, DE (US)

( * ) Notice: Subject to any disclaimer, the term of this patent is extended or adjusted under 35 U.S.C. 154(b) by 0 days.

(21) Appl. No.: 09/407,378

(22) Filed: Sep. 28, 1999

(51) Int. Cl.[7] ..... B31B 1/00
(52) U.S. Cl. ..... 493/22; 493/34
(58) Field of Search ..... 493/22, 8, 34, 493/223, 340; 83/948, 337

(56) References Cited

U.S. PATENT DOCUMENTS 4,724,429 A * 2/1988 Millen et al.
5,417,638 A * 5/1995 Anderson et al.
5,709,139 A * 1/1998 Shimizu et al.
5,842,397 A * 12/1998 Shimizu et al.
5,964,686 A * 10/1999 Bidlack et al.
6,055,795 A * 5/2000 Harding et al.
6,173,634 B1 * 1/2001 Lynch et al.
6,179,762 B1 * 1/2001 Harding et al.
6,185,912 B1 * 2/2001 Artois et al.

OTHER PUBLICATIONS

U.S. Patent Application No. 09/028,734 filed on Feb. 24, 1998 by Lynch et al.
U.S. Patent Application No. 09/240,982 filed on Jan. 29, 1999 by Krupica et al.

* cited by examiner

*Primary Examiner*—Eugene Kim
(74) *Attorney, Agent, or Firm*—Robert A. Sabourin; Joseph D. King

(57) ABSTRACT

A method, which is implemented via software on a computer, configures punches to be used on a web or sheet handling machine. The method includes: determining a queue of jobs to be processed on the machine; gathering setup information for each job; defining a punch configuration for each job; establishing punch sharing between jobs; and generating one or more punch configuration files for each job. The method can be transferred to a computerized controller via a computer-readable medium containing punch configuration code.

16 Claims, 4 Drawing Sheets

PUNCH CONFIGURATION SYSTEM AND METHOD

BACKGROUND OF THE INVENTION

1. Field of the Invention

The invention relates generally to a system and method for configuring punches, and more particularly, to a system and method for configuring, selecting and positioning punches for use with media in imagesetters or platesetters in the graphic arts industry.

2. Description of the Prior Art

In industries where web or sheet substrates are handled, there is often a need for providing punch holes, typically along an edge of the substrate, for securing or aligning the substrate on various machines. The positioning of the punch holes is sometimes critical.

One example of a machine which uses punches is an imagesetter or platesetter for transferring images onto photosensitive, light-sensitive or thermally sensitive media to make films and plates for subsequent transfer onto a finished product via a printing press. In the printing process, films are overlaid and must be aligned accurately to ensure a good quality image. Also, plates must be aligned on the printing press for accurate printing. Toward this end, registration openings or holes are punched in the films or plates to serve as alignment guides. The location of each pixel on each film or plate is determined with respect to the registration holes which are punched along an edge of the media, generally either the leading edge or a side edge. Typically, the openings must be punched within an accuracy of 0.001 inches (depending on the particular media used) with respect to the image on the medium. Examples of the use of low profile side punches in an internal drum imagesetter are described in U.S. patent application Ser. No. 09/240,982 filed on Jan. 29, 1999 by Krupica et al. This application is herein incorporated by reference in its entirety for background information which is non-essential, but useful in understanding the principles of the current invention.

The installation of punches on a machine can be considered in two parts. The first part is the mechanical installation of selected punches on the machine in the appropriate configuration. The second part is providing the machine with punch configuration data to account for the proper use and positioning of the punches which have been installed. Typically, punches are manually installed and information concerning the punch configuration is manually key-punched into the machine controller.

The issue of installing punches onto an imagesetter was addressed in U.S. patent application Ser. No. 09/028,734 filed on Feb. 24, 1998 by Lynch et al. which is incorporated by reference in its entirety for background information which is non-essential, but useful in understanding the principles of the current invention. In the past, it was necessary to install punches onto imagesetters at the factory where expensive machining tools were used to maintain the necessary accuracy. The '734 application discloses an improved method and apparatus for installing and aligning punches in an imaging system at any field or customer location using a punch band template. However, figuring out the placement of punches, then key punching that information along with other punch information to the imagesetter is done manually.

A primary object of the present invention is to overcome the above and other shortcomings in the prior art by providing an improved punch configuration method which is useful in any application where accurate punch alignment is desired or required for punching holes into either a web or sheet fed substrate.

SUMMARY OF THE INVENTION

A method, which is implemented via software on a computer, configures punches to be used on a web or sheet handling machine. The method includes: determining a queue of jobs to be processed on the machine; gathering setup information for each job; defining a punch configuration for each job; establishing punch sharing between jobs; and generating one or more punch configuration files for each job. The method can be transferred to a computerized controller via a computer-readable medium containing punch configuration code.

BRIEF DESCRIPTION OF THE DRAWINGS

The aforementioned aspects and other features of the invention are described in detail in conjunction with the accompanying drawings in which the same reference numerals are used throughout for denoting corresponding elements and wherein.

DETAILED DESCRIPTION OF THE PREFERRED EMBODIMENTS

Figure 1:
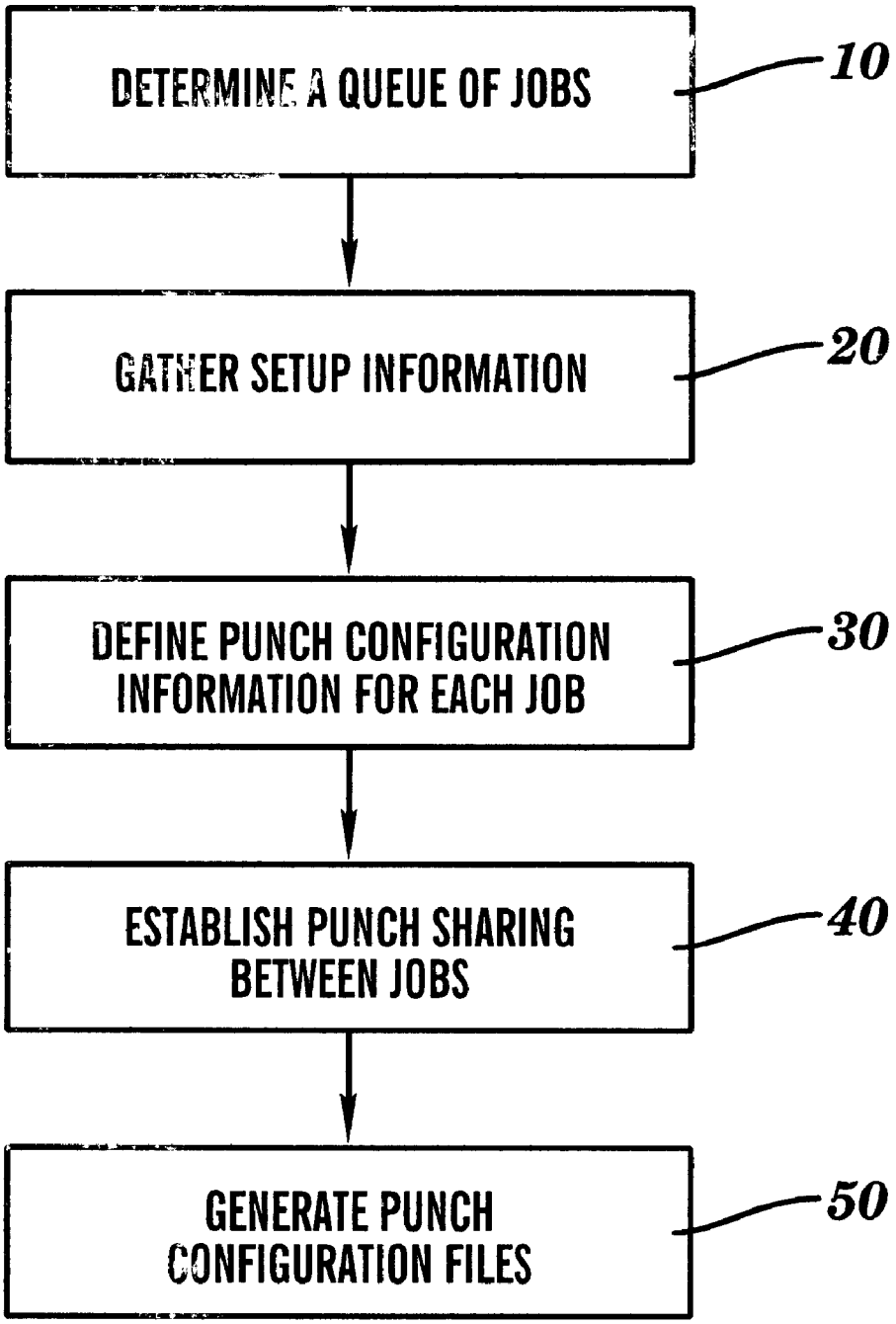
FIG. 1 is a flowchart diagram of a preferred embodiment of the inventive punch configuration method.

The present invention is a system and process for simplifying the configuration and installation of punches onto a machine which from time to time may require different punch configurations to satisfy a queue of jobs to be run on that machine. Various jobs to be performed on the imagesetter require many shapes and sizes of holes to be punched into the medium at various locations. The inventive principles can be applied to any machine or system whereby punch configurations may change for any reason.

The process described herein automates the comparison of customer requirements versus machine parameters and subsequently translates the product into code. Customer order entry information is input in terms of punch characteristics, media characteristics and press (machine) characteristics. This information is then organized into a single solution which will fit within the imagesetter constraints. The individual punch characteristics are compared against an existing database and assigned identification. These are then categorized and grouped into appropriate configurations, each configuration constrained by its' own dimensional parameters and the customer's image and/or press requirements. The configurations are fitted within the maximum image scan angle and interleaved such that there is no interference between the punches themselves, images and drum dependencies, and transport considerations. This then is the system configuration solution.

Having completed the input manipulation, the solution is translated to provide two sets of output data. First, a table is output with punch installation requirements for generating the punch band template and other data pertaining to a punch kit. Second, a system compatible file is generated and written to a floppy disc. This file will be transferred to the imagesetter from the installer's portable computer via a computer-readable medium, or directly downloaded. These two sets of output information are provided directly from the punch configuration program to the user and may be provided in other forms as required. This precludes the possibility of operator error during data entry and the time required for doing so.

In the preferred embodiment described herein, the computer program aids in computing the optimal position for side punches within an imagesetter. Side punches may be positioned anywhere along the side of the drum, within certain physical constraints such as maximum distance from the drum centerline, minimum spacing between punches, etc.

The program is divided into two major modules. The first is a database for storing information related to punches including, but not limited to, width, depth, shape, description and a comment. The operator accesses a dialog box used to enter punch configuration data. This data is entered by the user and serves as the basis for all configurations entered by the user.

The second module is used to configure the punches within the imagesetter. A graphical depiction of the imagesetter is presented. Information is shown about the imagesetter such as maximum image locations and the punch reference points. Punch configurations are created by entering relevant data into a dialog box. This information includes the name of the configuration, the number of punches within it, and the maximum image width. The placements of the punches within the configuration are entered via another dialog box. Placement of the punches relative to the center of the media, and the punch shape is entered. The punch shape is chosen from the list of punches in the database.

Once the information for all configurations has been entered, the user then positions the configurations relative to each other and the imagesetter. This is accomplished by using the arrow keys, to move the configuration a certain distance. The movement scale is adjustable by the user. Graphical feedback is given by changing the position of the configurations relative to the imagesetter, and by changing the color of the depiction of each punch to reflect the validity of the current position of the configuration. Punch states such as ALL OK, punches too close together, and if punches are shared, can be depicted. As the punch configurations are moved, the program checks several factors such as, minimum spacing between punches, whether or not the image position would fall outside of the maximum image area, whether or not a punch is shared between two configurations. The program will not allow configurations to be placed in such a manner that any of the prescribed constraints are invalidated. Once this sharing has been established, the movement of one configuration drives the other.

In the case of a configuration that does not have a punch near a PRP, or in the case where placing a punch at one of the PRPs would violate a constraint, a tooling notch can be placed within the configuration. This notch is placed into the punch band and is used to located the band within the imagesetter.

The following preferred embodiment applies the method of FIG. 1 via computer software to an internal drum imagesetter or platesetter for transferring images onto a medium such as a film or a printing plate. First, the mechanical installation of punches is explained, followed by details of the computerized punch configuration method.

Figure 3A:
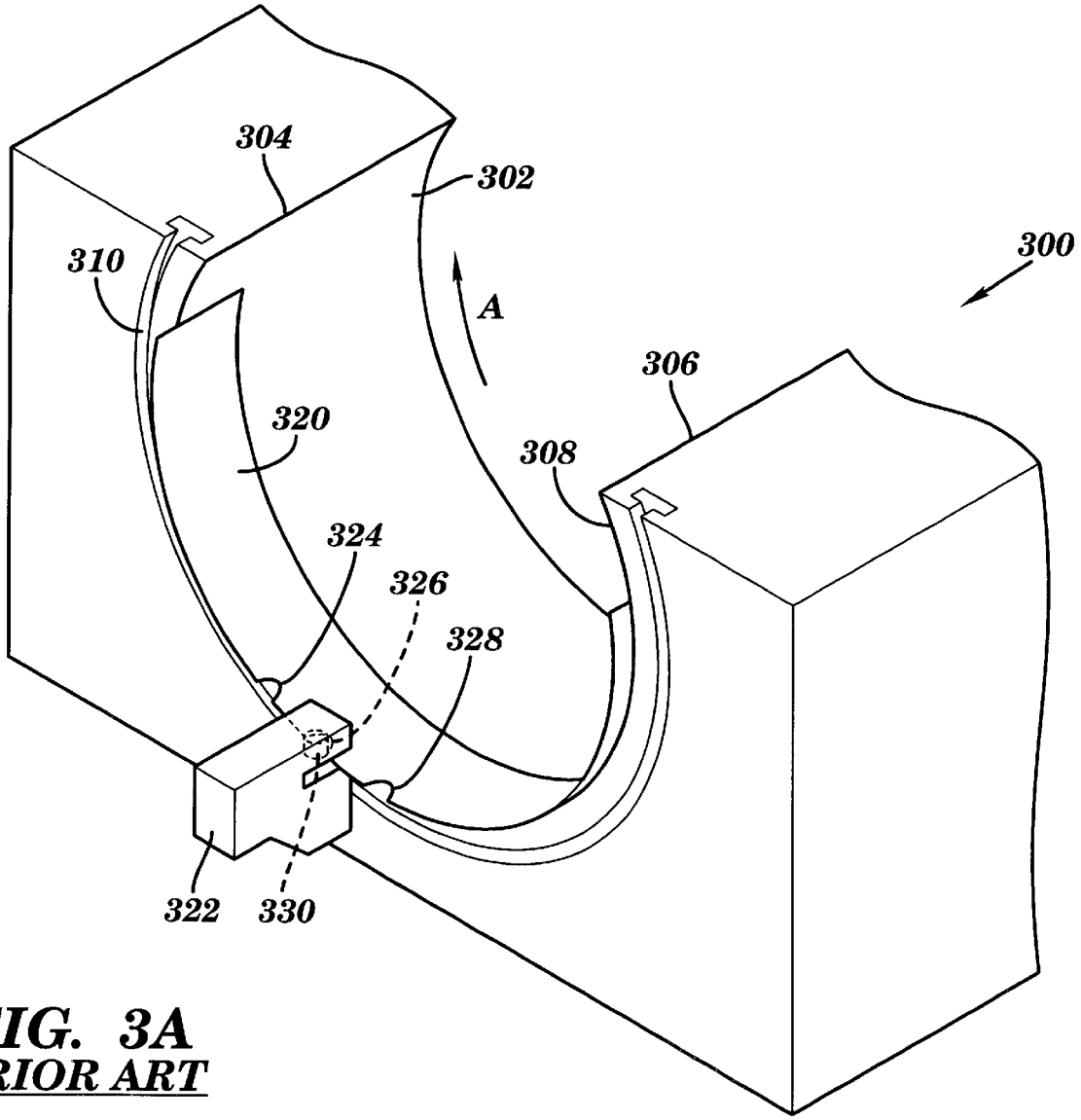
FIG. 3A PRIOR ART
FIG. 3A is a perspective view of one machine, an internal drum imagesetter, which would benefit from the installation of punches using the punch configuration method of FIG. 1.
Figure 3B:
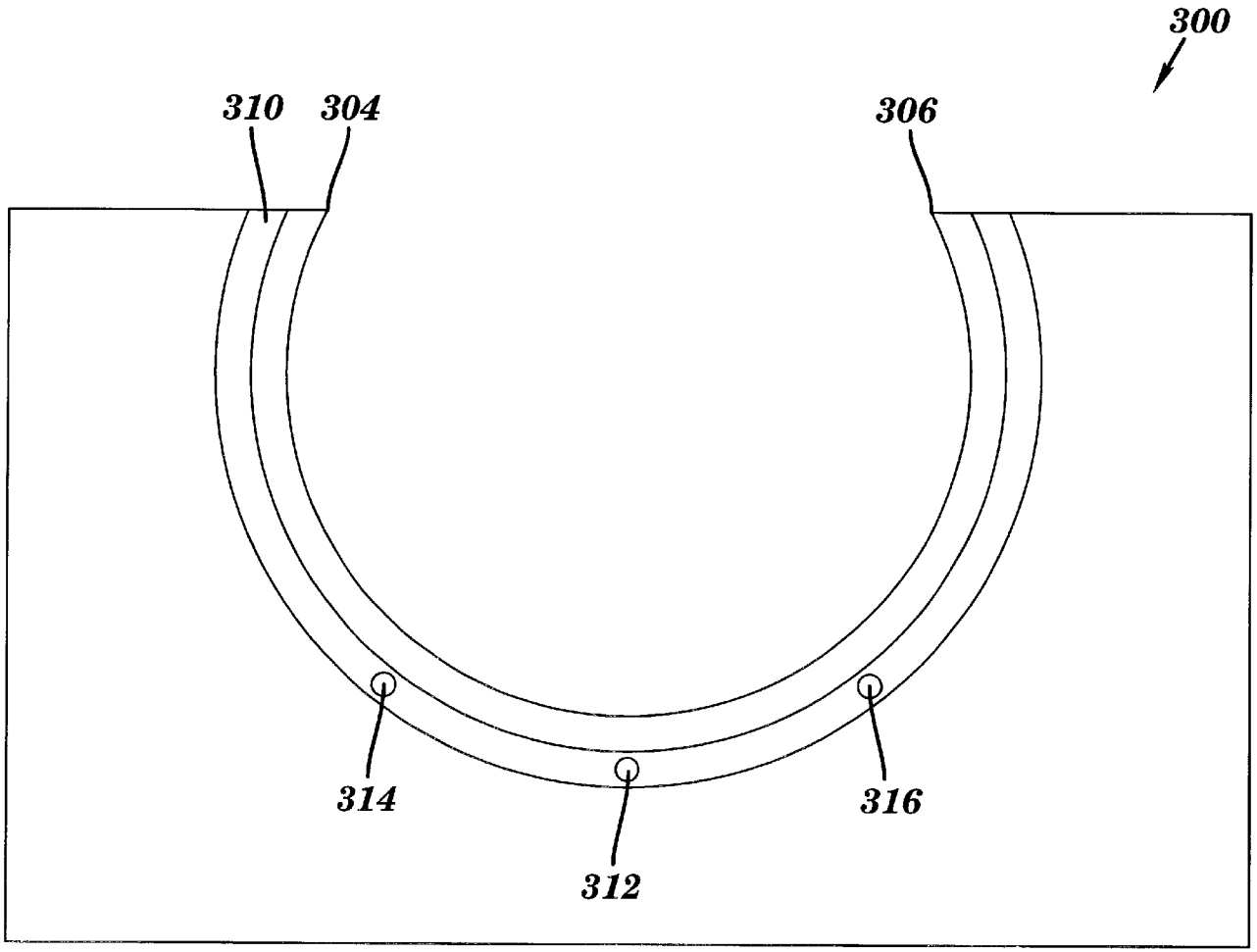
FIG. 3B PRIOR ART
FIG. 3B is a front view of the internal drum imagesetter of FIG. 3A.

The mechanical installation of punches onto an internal drum imagesetter is illustrated in FIGS. 3A and 3B as described in the aforementioned '734 patent application. The '734 method uses an internal drum 300 having a "T" shaped slot (T-slot) 310 for movably positioning one or more side punches 322 about the cylindrically shaped imaging surface 302 of the internal drum 300. The proper alignment of the side punches 322 is achieved using a punch band template 320. The template 320 includes a plurality of notches, such as notches 324 326 and 328 shown in FIG. 3A. Each notch is used to position a side punch 322 on the internal drum 300. The '734 method discloses the installation of punches onto an internal drum of an imagesetter by: installing a first punch onto the internal drum at a predetermined reference point; providing a punch band template having notches each configured to receive a punch pin of a respective punch; positioning the template on the internal drum such that the punch pin of the first punch is located within a predetermined one of the notches in the template which corresponds to the predetermined reference point; and installing each of the remaining punches onto the internal drum by reference to the remaining notches on the template.

A typical three punch mechanical installation works as follows. A punch band template 320 is manufactured to locate the three notches 324, 326 and 328 at predetermined positions. One or more punch reference points (PRPs) have been machined at the factory into the imagesetter at known positions. FIG. 3B shows three PRPs, 312, 314 and 316. Any number of PRPs can be used within limits for allowing adequate spacing to mount the punches on the drum 300. The PRPs are known reference points on the drum 300 which are preferably and most easily machined into the edge of the drum during its fabrication. A punch 322 is installed at the punch reference point (PRP) 312. After the first punch 322 is installed as shown in FIG. 3A, the punch band template 320 is placed onto the drum surface 302 so that a punch 330 is mated with the notch 326. Thereafter two additional punches are installed using notches 324 and 328. The template 320 is removed and the mechanical punch installation on the drum 300 of the imagesetter is complete.

The punch configuration method of FIG. 1, which is implemented via software on a computer, is used to program the imagesetter and to provide punch band template configuration data. The method can be embedded in the code of a computer program or it can be installed via firmware. It can be installed into the memory of a computer system or transferred to the computer via any known computer-readable medium such as a floppy disk, CDROM, ZIP™ disk, etc. The computer can be a stand-alone computer, or it can be a computerized controller which is integrated into a system, such as an imagesetter.

All standard and variable information regarding punches and their applications is correlated, checked against machine parameters, translated to a useable code and saved in computer memory. Punch and notch shapes, sizes, combinations, quantities, punch sharing, medium dimensions, image sizes and locations on the medium are some of the considerations which are integrated into the method. As the number and mix of customer requirements are unpredictable, the task of configuring the imagesetter can be quite complicated.

The basic punch configuration method of FIG. 1 includes: determining a queue of jobs to be processed on the machine; gathering setup information for each job; defining a punch configuration for each job in the queue; establishing punch sharing between jobs; and generating one or more punch configuration files for the queue of jobs.

Jobs queued on the imagesetter may each require a different punch configuration. Each of these configurations must be separately, manually key-punched into the imagesetter prior to initiation of each job. The punch setup process is time consuming, disruptive to the workflow of the imagesetter, and prone to error. The inventive system and process mitigates these shortcomings by use of a computer automated software program used in conjunction with a punch band template. The software accounts for all variables in the punch setup process. Moreover, multiple punch configurations can share one or more punches for handling multiple jobs on the imagesetter.

The system operator runs the computer punch configuration software which has numerous pull-up screens for selection or input of data. In box 10 of FIG. 1, the operator creates a list of jobs to be run on the imagesetter. For instance, three separate jobs may be listed. Each job may have different hole punching requirements. In box 20, setup information is gathered for each job. The setup information for each job includes the selection of a measurement system (e.g. metric or English), selecting a type of media, and selecting dimensions and positioning of the media and the image on the media. In box 30, punch configuration information is selected or input for each job. The punch configuration information includes the number of punches, the type of punches and the punch positioning with respect to the image on the media.

If a common punch can be used for more than one of the three jobs in the queue, then punch sharing is an alternative. Punch sharing is established between jobs in box 40. The locations of the punch configurations within the drum are checked. Typically during setting up of shared punches, one or both of the configurations having shared punches would have to move in order to get the punches to line up and to have the configurations fit within the engine parameters. The box 40 of punch sharing includes: comparing types of punches and positioning of punches between each job in the queue; establishing common types of punches and common positions of punches between each job in the queue; and confirming that no conflicts exist between the types of punches and positioning of punches in a shared punch configuration.

Once all the setup and punch configuration files have been processed, punch configuration files are generated for use in manufacturing the punch band template, and for downloading to the controller of the imagesetter for proper punch operation during each job.

The operation of the inventive system and method is illustrated with the aid of FIGS. 2A–E. One of the requirements in any punch configuration is the relative positioning of the punches with respect to one another, and with respect to the image to be transferred onto the medium. The optics and control system of the imagesetter transfer the image onto the medium within the drum. For the examples of FIGS. 2A–E, the location of the primary image area is given as being between the borders B1 and B2, although those boundaries could change for different jobs.

The drum 300 includes three punch reference points (PRPs) 312, 314 and 316 (see FIG. 3B). At least one PRP is necessary for proper mechanical configuration of the punches in the drum, although only one PRP is used for any given set of configurations, i.e. for each punch template band. PRP1, PRP2 and PRP3 in FIGS. 2A–E correspond to reference numerals 312, 314 and 316 in FIG. 3B. Typically, PRP1 is labeled the center or default reference point since it is located at the center of the image in the fastscan direction which may or may not be the actual center of the drum. The fastscan direction corresponds with the radial direction of the image on the drum.

Figures 2A, 2B, 2C, 2D, 2E:
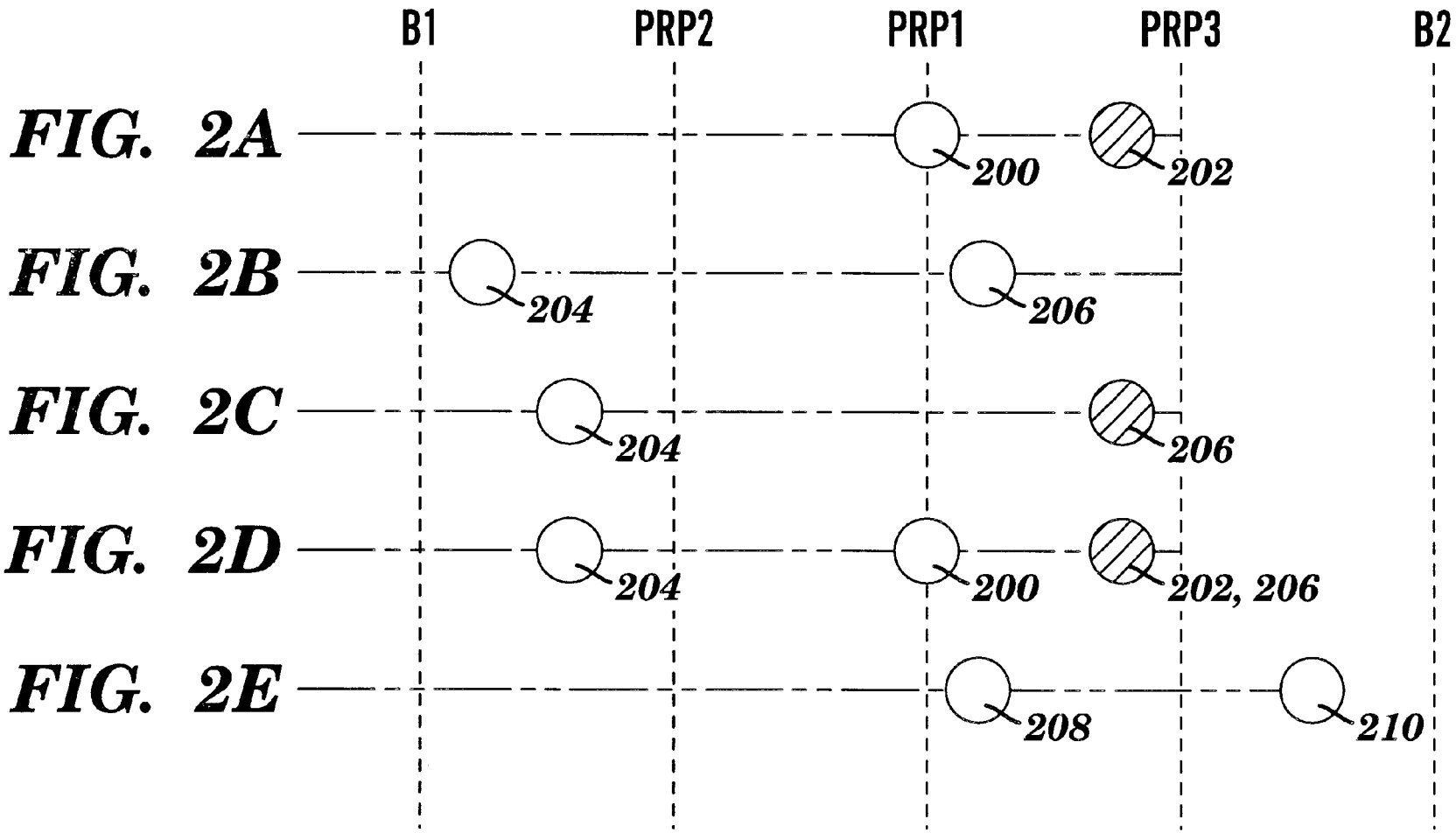
FIGS. 2A–2E are diagrams illustrating various punch configurations which are useful for demonstrating the punch configuration method of FIG. 1.

The first punch configuration of FIG. 2A requires two round 0.375 inch punches 200 and 202 which are 4 inches apart (all punch measurements are from the center of the punch). The punch 200 must be distanced at least 8 inches from the border B1. By positioning punch 200 at PRP1, this configuration is satisfied. For this example, all of the punches in FIGS. 2A–E are the same size and shape, e.g. providing 0.375 inch round holes, although other punches can be used as desired.

The second punch configuration of FIG. 2B requires two 0.375 inch round hole punches 204 and 206 to be spaced apart 10 inches, while the minimum distance between the border B1 and punch 204 is 2 inches. Using the punch configuration software, the operator can maintain relative positioning of the two punches 204 and 206 while simultaneously shifting the punch pair to the right until the position of punch 206 aligns with the position of punch 202 in punch configuration 1 (see FIG. 2C). The alignment can be signaled, for instance, by each of the aligned punches changing to a uniform color (designated by crosshatching in the drawing) on the operator's computer monitor. The result shown in FIG. 2D is a shared punch configuration which requires three punches for handling the first punch configuration of FIG. 2A for a first job, and the second punch configuration of FIG. 2B for a second job. Either job can be performed with the punches installed as shown in the shared punch configuration of FIG. 2D, rather than requiring two separate punch setups, i.e. two separate mechanical punch installations coupled with two separate programming requirements for the imagesetter. In the shared configuration, the imagesetter controller will use the punch configuration to determine which punches are used for each job.

FIG. 2E illustrates a third punch configuration whereby a punch 208, in order to satisfy spacing requirements, must be placed in a position where it would interfere with a reference punch mounted at the center PRP1. In this case, either PRP2 or PRP3 can be used in conjunction with a tooling notch in the punch band template. First a reference punch is mounted at PRP2, then the two punches 208 and 210 are mounted onto the drum in the manner previously described. The reference punch and the punch band template are removed to complete the mechanical punch configuration of FIG. 2E. In some cases, the reference punch may remain in the machine to be used for a job.

It is to be understood that the above described embodiments are merely illustrative of the present invention and represent a limited number of the possible specific embodiments that can provide applications of the principles of the invention. Numerous and varied other arrangements may be readily devised in accordance with these principles by those skilled in the art without departing from the spirit and scope of the invention as claimed.

What is claimed is:

1. A computer-readable medium containing code for configuring punches to be used on a web or sheet handling machine, the code performing:

prompting an operator to input or select a queue designating two or more jobs to be performed on the machine;

prompting an operator to input or select setup information for each job;

prompting an operator to input or select punch configuration data for each job;

prompting an operator to input or select punch sharing between jobs;

aiding an operator to determine a single configuration of a plurality of punches useable for all jobs previously designated in said queue;

generating a single configuration file containing data for configuring said plurality of punches into a single configuration of punches to be used for all jobs previously designated in said queue; and wherein said setup information comprises a dimension and a position of the media and a dimension and a position of an image on said media.

2. The medium of claim 1 wherein, for each job, the setup information further comprises:

a measurement system; and a type of web or sheet substrate.

3. The medium of claim 2 wherein the punch configuration data comprises: a number of punches; types of punches; and punch positioning with respect to the image on the substrate.

4. The medium of claim 3 wherein punch sharing comprises: comparing types of punches and positioning of punches between each job; establishing common types of punches and common positions of punches between each job; and confirming that no conflicts exist between the types of punches and positioning of punches in a shared punch configuration.

5. The medium of claim 4 wherein the punch sharing further comprises moving one or more of the punches if a positioning conflict is evident.

6. The medium of claim 1 wherein said code further generates an output table comprising punch configuration installation data used to manufacture a template for positioning selected punches on the machine.

7. The medium of claim 6 wherein the template is manufactured to include a tooling notch.

8. The medium of claim 1 wherein the machine is an internal drum imagesetter.

9. A computerized controller having memory containing code for configuring punches to be used on a web or sheet handling machine, the code capable of prompting an operator to:

select or input a queue designating two or more jobs to be processed on the machine;

select or input setup information for each job;

select or input a punch configuration for each job;

select or input punch sharing between jobs;

aiding an operator to determine a single configuration of a plurality of punches useable for all jobs previously designated in said queue;

generating a single configuration file containing data for configuring said plurality of punches into a single configuration of punches to be used for all jobs previously designated in said queue; and wherein said setup information comprises a dimension and a position of the media and a dimension and a position of an image on said media.

10. The controller of claim 9 wherein, for each job, the setup information comprises:

a measurement system; and a type of web or sheet substrate.

11. The controller of claim 10 wherein the punch configuration for each job comprises: a number of punches; types of punches; and punch positioning with respect to the image on the substrate.

12. The controller of claim 11 wherein punch sharing comprises: comparing types of punches and positioning of punches between each job in the queue; establishing common types of punches and common positions of punches between each job in the queue; and confirming that no conflicts exist between the types of punches and positioning of punches in a shared punch configuration.

13. The controller of claim 12 wherein punch sharing further comprises moving one or more of the punches if a positioning conflict is evident.

14. The medium of claim 1 wherein said code further generates an output table comprising punch configuration installation data used to manufacture a template for positioning selected punches on the machine.

15. The controller of claim 14 wherein the template is manufactured to include a tooling notch.

16. The controller of claim 9 wherein the machine is an internal drum imagesetter.

* * * * *

UNITED STATES PATENT AND TRADEMARK OFFICE

CERTIFICATE OF CORRECTION

PATENT NO. : 6,368,263 B1
DATED : April 9, 2002
INVENTOR(S) : Richard James Lynch et al.

It is certified that error appears in the above-identified patent and that said Letters Patent is hereby corrected as shown below:

Title page,
Item [73], change "DE" to -- MA. --.

Signed and Sealed this

Tenth Day of September, 2002

*Attest:*

*Attesting Officer*

JAMES E. ROGAN
*Director of the United States Patent and Trademark Office*